US005176183A

United States Patent [19]

Koch

[11] Patent Number: 5,176,183

[45] Date of Patent: Jan. 5, 1993

[54] HEDDLE END LOOP DESIGN WITH ASYMETRICALLY CURVED INNER EDGE

[75] Inventor: Bernhard Koch, Horgenberg, Switzerland

[73] Assignee: Grob & Co. Aktiengesellschaft, Horgen, Switzerland

[21] Appl. No.: 756,336

[22] Filed: Sep. 6, 1991

[30] Foreign Application Priority Data

Nov. 8, 1990 [DE] Fed. Rep. of Germany ..... 4035582

[51] Int. Cl.[5] ..... D03C 9/02

[52] U.S. Cl. ..... 139/93

[58] Field of Search ..... 139/93, 96, 368

[56] References Cited

U.S. PATENT DOCUMENTS 2,964,066 12/1960 Ramseier ..... 139/93
3,304,957 2/1967 Koch ..... 139/93
3,437,113 4/1969 Staehli ..... 139/93
4,383,557 5/1983 Graf ..... 139/93

*Primary Examiner*—Andrew M. Falik
*Attorney, Agent, or Firm*—Watson, Cole, Grindle & Watson

[57] ABSTRACT

The end loop of a heddle has at its opening an inner edge that comes into contact with the slide bar, the inner edge having an asymmetric contour relative to the longitudinal line of symmetry passing through the opening with an arc on the side of the back part which has a greater radius of curvature and an arc on the side of the free shank of the end loop which has a smaller radius of curvature. Compared with conventional heddles with short corner arcs at the inner edge of the end loop this end loop is strengthened, particularly in the zone of the back part prone to breakage, by the provision of the arc with the larger radius of curvature on the side of the back part. A rectilinear section connecting to the two arcs prevents jamming of the heddle on the slide bar.

5 Claims, 3 Drawing Sheets

HEDDLE END LOOP DESIGN WITH ASYMETRICALLY CURVED INNER EDGE

BACKGROUND OF THE INVENTION

The invention relates to a heddle with J-shaped or C-shaped end loops arranged at the end of the heddle shaft for mounting support on a heddle slide bar of a heddle shaft by engaging around the bar with one or two mutually oppositely-lying free shanks of the end loop.

The currently used heddles of the above-specified type with a straight end loop shape have small radii at the inner edges of the opening of the end loop and have a relatively large amount of play relative to the slide bar in order that they may be freely adjusted on the latter and that they may match the tensile forces of the thread in the direction of the warp. Since nowadays weaving machines are operated at ever higher r.p.m., the heddles in the heddle shaft (which performs a very rapid oscillating movement) are correspondingly subjected to ever higher demands, because the two frame rods of the frame-shaped heddle shaft carrying the heddle do not remain parallel to each other due to the flexure caused by the oscillating movement, so that at high load breakages occur at the end loops of the heddles, and more particularly in the back part of the loop in the region next to the inner contact edge on the slide bar. Hence by means of several measures attempts have been made to strengthen the end loop, e.g. by constructing the inner contact edge of the end loop in semi-circular form with which inner edge the end loop bears on a correspondingly formed slide bar. However, a heddle with a semi-circular inner edge of the end loop has a tendency to jamming on the slide bar which then has as a consequence not only a breakage of the heddle but also the formation of stripy faults in the fabric that is produced.

SUMMARY OF THE INVENTION

Consequently, the present invention set itself the task so to form a heddle at each end loop that it can withstand considerably higher loads without risk of breakage and in addition also has sufficient play relative to the slide bar so as to exclude the possibility of jamming and the negative effects resulting therefrom. For the solution of this task the heddle has the characteristics according to claim 1. Preferably, the inner edge contour of the end loop is arcuate on the side of the rear part with a radius of curvature greater than the radius of curvature of the arc on the opposite side of the free shank. This greater arc of curvature may also have preferably a radius of curvature which gradually increases towards the centre of the heddle so that the run of the inner edge has a shape similar to a parabola.

In order to prevent jamming of the heddle on the slide bar, in a preferred embodiment the inner edge has a rectilinear edge section between the arcs and the arcs begin at the two ends of this section and are disposed asymmetrically relatively to the longitudinal line of symmetry. With the rectilinear edge section and the differing curvatures of the oppositely lying sides of the longitudinal line of symmetry the heddle has sufficient free play on the slide bar to prevent the disadvantages of jamming and the occurrence of stripy faults in the fabric.

BRIEF DESCRIPTION OF THE DRAWINGS

Preferred embodiments of the invention are described in greater detail hereafter with reference to the drawings which show.

DETAILED DESCRIPTION OF THE INVENTION

Figure 1:
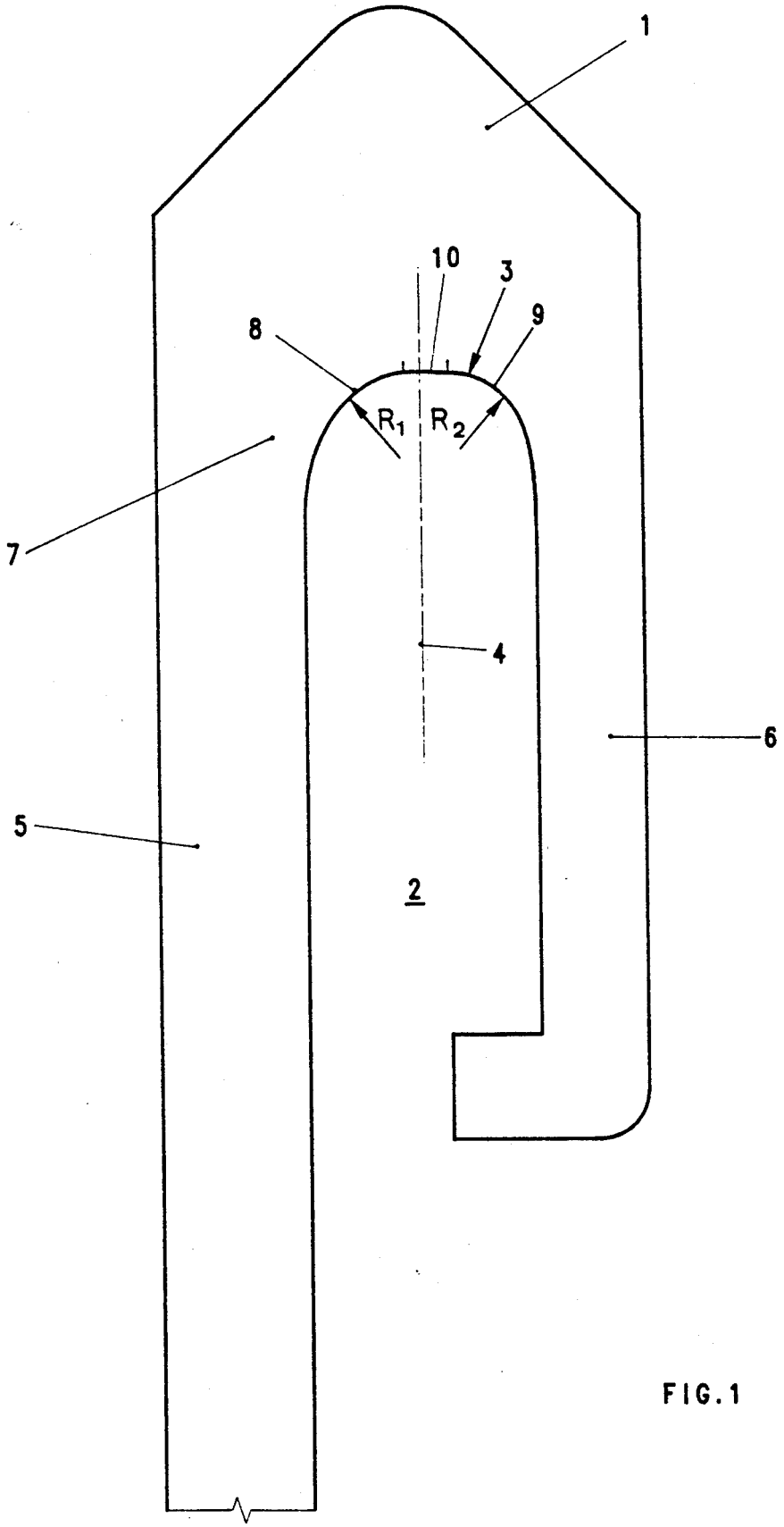
FIG. 1 is a plan view of a J-shaped end loop on an enlarged scale.

Only one of two J-shaped end loops 1 is shown broken from a non-illustrated heddle. The non-illustrated slide bar engages into the opening 2 of the end loop so that the end loop with the inner edge 3 of the opening 2 bears against the slide bar. The back part 5 extends on one side and the free shank 6 extends on the other side of the longitudinal symmetry line 4 extending through the middle of the end loop opening 2. The back part 5 contains the zone 7 most endangered at high loads in which it can break, the zone being somewhat at the height of the upper inner edge 3 on the opening 2 of the end loop.

Figure 5:
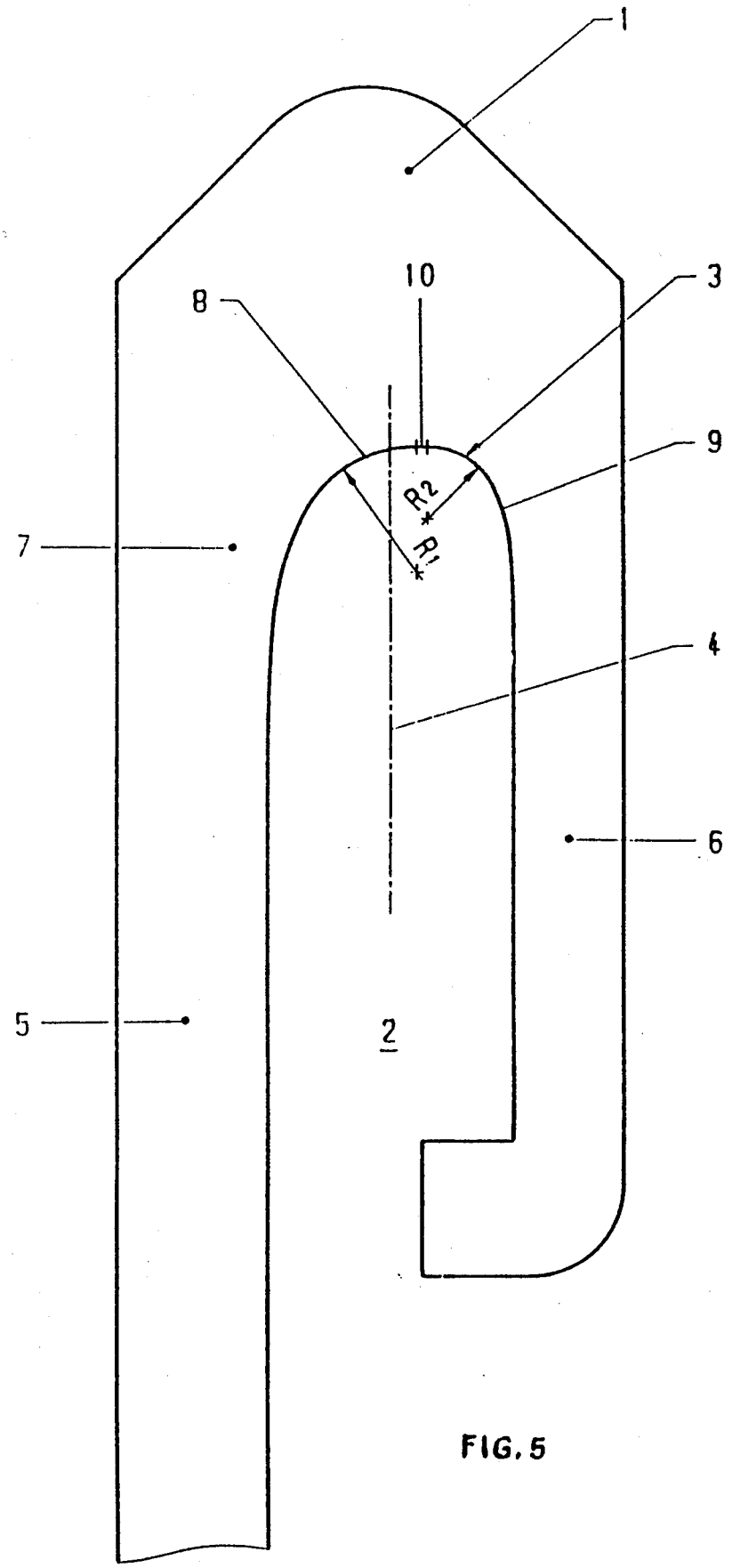
FIG. 5 is a view similar to FIG. 1 of another embodiment of the invention.

In order to strengthen the end loop in this endangered zone 7 the inner edge of the end loop has an asymmetric contour relative to the longitudinal line of symmetry 4 in the region 3 coming into contact with the narrow side of the slide bar. Preferably, the arc 8 on the side of the back part 5 has a greater radius of curvature R1 than the radius R2 of the arc 9 on the oppositely lying side of the free shank 6. In every case an asymmetry is present relative to the distance between the center point of curvature from the longitudinal line of symmetry 4. The arcs 8 and 9 of the inner edge 3 may have a circular form. Preferably, the arc 8 on the side of the back part has a radius of curvature which increases in magnitude toward the center of the heddle, similar in shape to that of a parabola, and goes gradually over into the straight part of the boundery edge of the back part 5. In the FIG. 5 embodiment the arc 8 may with its right end also extend beyond the longitudinal line of symmetry 4. Hence the arc 9 may have a smaller radius of curvature R2 because the load on the side of the free shank 6 is appreciably smaller. Thus, rectilinear edge section 10 lies to the right of line of symmetry 4 as shown in FIG. 5.

In order to prevent jamming of the heddle on the slide bar, the inner edge coming into contact with the slide bar has a rectilinear edge section 10 between the arc 8 and the arc 9. This rectilinear edge section is preferably asymmetrical relatively to the longitudinal line of symmetry 4, i.e. the two arcs 8 and 9 begin at end points which lie at different distances from the longitudinal line of symmetry. Thus, edge section 10 is crossed by the longitudinal line of symmetry 4 to form two segments on edge section 10 of different length. The rectilinear section 10 and the described shape of the arcs of the inner edge 3 provide sufficient free play of the heddle on the slide bar in order to exclude the possibility of jamming of the heddle and the occurrence of warp marks in the fabric that is being produced.

Figures 2, 3, 4:
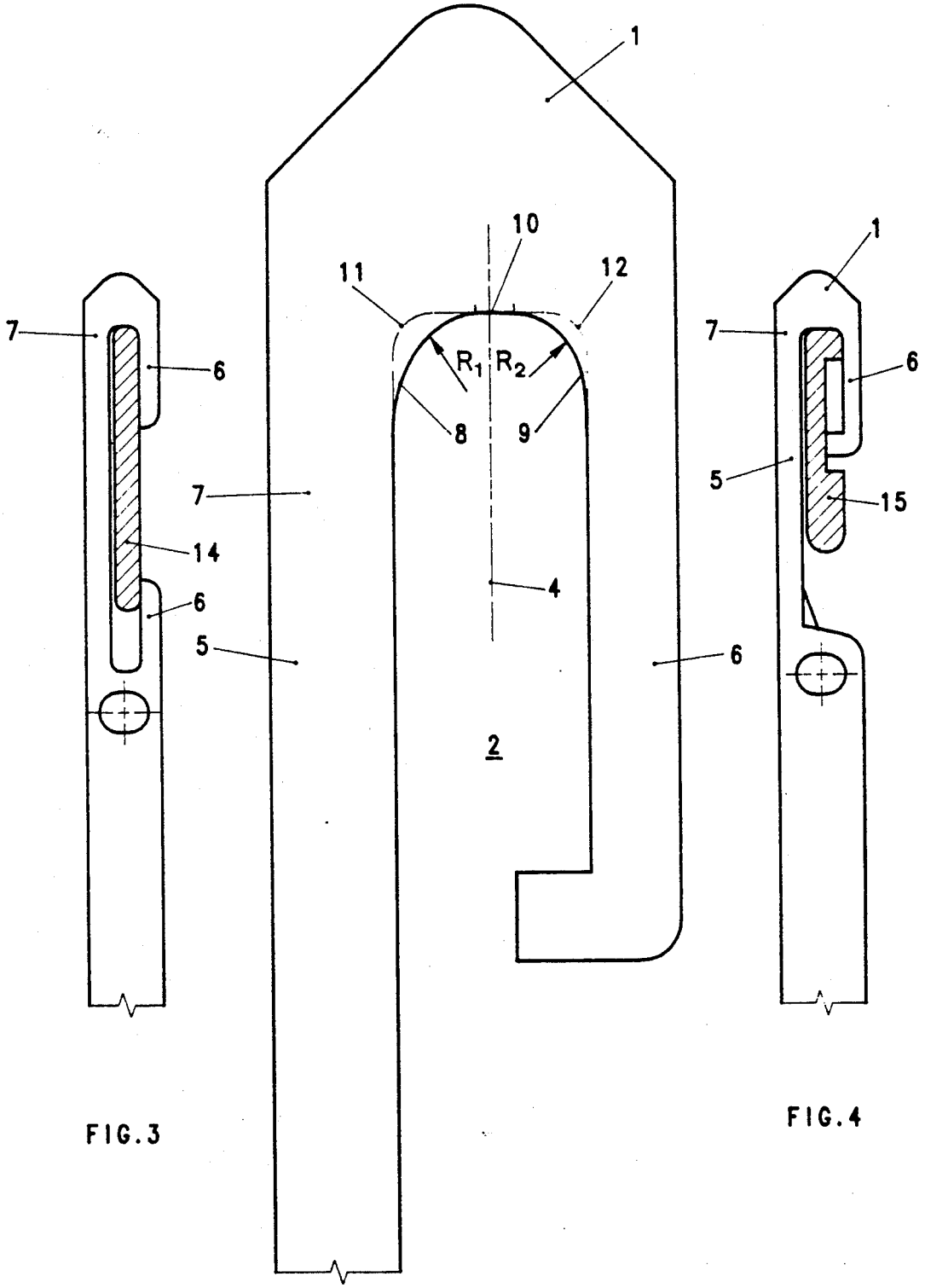
FIG. 2 is a view similar to FIG. 1, the hitherto conventional shape being shown in dashed outline.
FIGS. 3 and 4 are plan views of C-shaped and J-shaped end loops shown together with their associated slide bars in cross-section.

In FIG. 2 broken lines illustrate the hitherto conventional heddle corner parts 11 and 12 in order to make clear the difference relative to FIG. 1.

In the above described J-shaped end loop only one inner edge is formed in the manner described. In contrast thereto the C-shaped end loop according to FIG. 3 has two mutually oppositely lying inner edges of the end loop opening that come into contact with the slide bar 14. In this C-shaped end loop the inner edge facing the slide bar may be formed in the same manner as described before, but on the other hand one may dispense with the special formation of the inner edge described above and may instead provide an inner edge according to FIG. 2 with conventional circular arcs because the part of the end loop bearing against the centre of the heddle is less loaded.

FIG. 4 shows the above described J-shaped end loop 1 on a slide bar 15.

I claim:

1. A heddle with a J-shaped or C-shaped end loop arranged at one or both ends of the heddle, for the mounting of the heddle on a supporting slide bar of a heddle frame by engaging the bar with a back part and one shank or two oppositely lying free shanks respectively of the end loop, wherein the region of an inner edge of the end loop, directed toward the end of the heddle and provided for coming into contact with a narrow side of the slide bar has an asymmetric contour relative to a longitudinal line of symmetry through the end loop, the contour of the inner edge having arcs of which the distance between the end points of their radiuses of curvature to the longitudinal line of symmetry is different.

2. A heddle according to claim 1, wherein the inner edge contour of the end loop on the side of the back part has one of said arcs with a radius of curvature greater than the radius of curvature of the arc on the oppositely lying side of the free shank.

3. A heddle according to claim 2, wherein the arcuate inner edge of the end loop on the side of the back part has a radius of curvature which increases in magnitude towards the center of the heddle.

4. A heddle according to claim 1, the arc of the inner edge of the end loop on the side of the back part (5) extends beyond the longitudinal line of symmetry.

5. A heddle according to claim 1, wherein the inner edge has a rectilinear edge section between said arcs, which edge section is crossed by the longitudinal line of symmetry to form two segments on the edge section of different length.

* * * * *